US007896538B2

(12) United States Patent
Wright

(10) Patent No.: US 7,896,538 B2
(45) Date of Patent: Mar. 1, 2011

(54) POWER SYSTEM FOR A SMALL LOAD CONCRETE TRUCK DRUM

(76) Inventor: Ian M. Wright, Kent, WA (US)

( * ) Notice: Subject to any disclaimer, the term of this patent is extended or adjusted under 35 U.S.C. 154(b) by 962 days.

(21) Appl. No.: 11/675,206

(22) Filed: Feb. 15, 2007

(65) Prior Publication Data

US 2008/0198686 A1 Aug. 21, 2008

(51) Int. Cl.
*B28C 5/42* (2006.01)

(52) U.S. Cl. ..... 366/61; 366/54; 180/53.4

(58) Field of Classification Search ..... 366/53–63, 366/232–233; 180/53.4, 53.8
See application file for complete search history.

(56) References Cited

U.S. PATENT DOCUMENTS

| | | | | | |
|---|---|---|---|---|---|
| 3,062,515 | A * | 11/1962 | Green | 366/47 |
| 3,080,152 | A * | 3/1963 | Lendved | 366/44 |
| 3,160,398 | A * | 12/1964 | Green | 366/61 |
| 3,173,258 | A * | 3/1965 | Hare et al. | 60/399 |
| 3,767,171 | A * | 10/1973 | Dunmire | 366/30 |
| 3,773,304 | A * | 11/1973 | Hodgson | 366/61 |
| 4,097,925 | A * | 6/1978 | Butler, Jr. | 366/2 |
| 4,614,146 | A * | 9/1986 | Ross et al. | 366/40 |
| 4,846,581 | A * | 7/1989 | Osterlund et al. | 366/61 |
| 6,286,987 | B1 * | 9/2001 | Goode et al. | 366/60 |
| 6,923,566 | B2 * | 8/2005 | Willbee, Jr. | 366/61 |
| 7,753,148 | B2 * | 7/2010 | Kokot et al. | 180/53.8 |
| 2003/0223304 | A1 * | 12/2003 | Willbee, Jr. | 366/61 |
| 2008/0198686 | A1 * | 8/2008 | Wright | 366/61 |

FOREIGN PATENT DOCUMENTS

JP 2003246239 A * 9/2003

OTHER PUBLICATIONS

Allison Transmission brochure, Aug. 2008.*

* cited by examiner

*Primary Examiner*—Charles E Cooley
(74) *Attorney, Agent, or Firm*—Clark A. Puntigam; Jensen & Puntigam, P.S.

(57) ABSTRACT

A power take-off unit is connected to a power take-off gear/port on a concrete mixing truck transmission, the power take-off unit being driven by the engine so it is always providing power as long as the engine is running. A hydraulic pump is connected to and driven by the power take-off unit. Hydraulic lines connect the pump to a planetary drive assembly for the concrete mixing drum; the drum itself is capable of receiving only a small/light load of concrete, in the range of two to five cubic yards.

5 Claims, 3 Drawing Sheets

POWER SYSTEM FOR A SMALL LOAD CONCRETE TRUCK DRUM

TECHNICAL FIELD

This invention relates generally to power systems for turning concrete truck drums, and more specifically concerns an engine-driven power system for use with small-load concrete truck drums.

BACKGROUND OF THE INVENTION

Large concrete delivery trucks with rotating (spinning) drums which can accommodate 9-11 yards or even more of concrete are well known. In operation, it is important that the drum be kept spinning, regardless of whether the truck is moving or at a standstill. This maintains the concrete within the drum in a desired mix state.

In order to accomplish this, power for the spinning drum on the large concrete trucks is taken from the engine flywheel. In this arrangement, the drum continues to spin as long as the engine is running.

Small-load concrete trucks, e.g. those trucks having a 2-5 cubic yard capacity, also have used flywheel take-off systems to provide power for spinning of the drum. However, this arrangement has some disadvantages for smaller or medium-sized commercial trucks which are not specifically manufactured to carry concrete drums. Hence, it is desirable for a concrete truck with a small load drum to have a power system which does not use the engine flywheel and which spins the concrete drum as long as the engine is running.

DISCLOSURE OF THE INVENTION

Accordingly, the present embodiment is a power system for turning a drum on a concrete mixer truck, comprising: a power take-off unit connected to a power take off gear in a transmission for the concrete mixer truck, wherein the power take-off gear is driven by the engine, so that it is always operating, driving the power take-off unit, when the engine is running, regardless of whether the transmission is engage or not; a hydraulic pump powered by the power take-off unit; and hydraulic lines connecting the pump to a fluid reservoir and to a drive system for a mixing drum on the truck, wherein the mixing drum is capable of receiving a load of concrete in the range of only two to five cubic yards, wherein the mixing drum continues to turn as long as the engine of the truck is running.

BEST MODE FOR CARRYING OUT THE INVENTION

Figure 1:
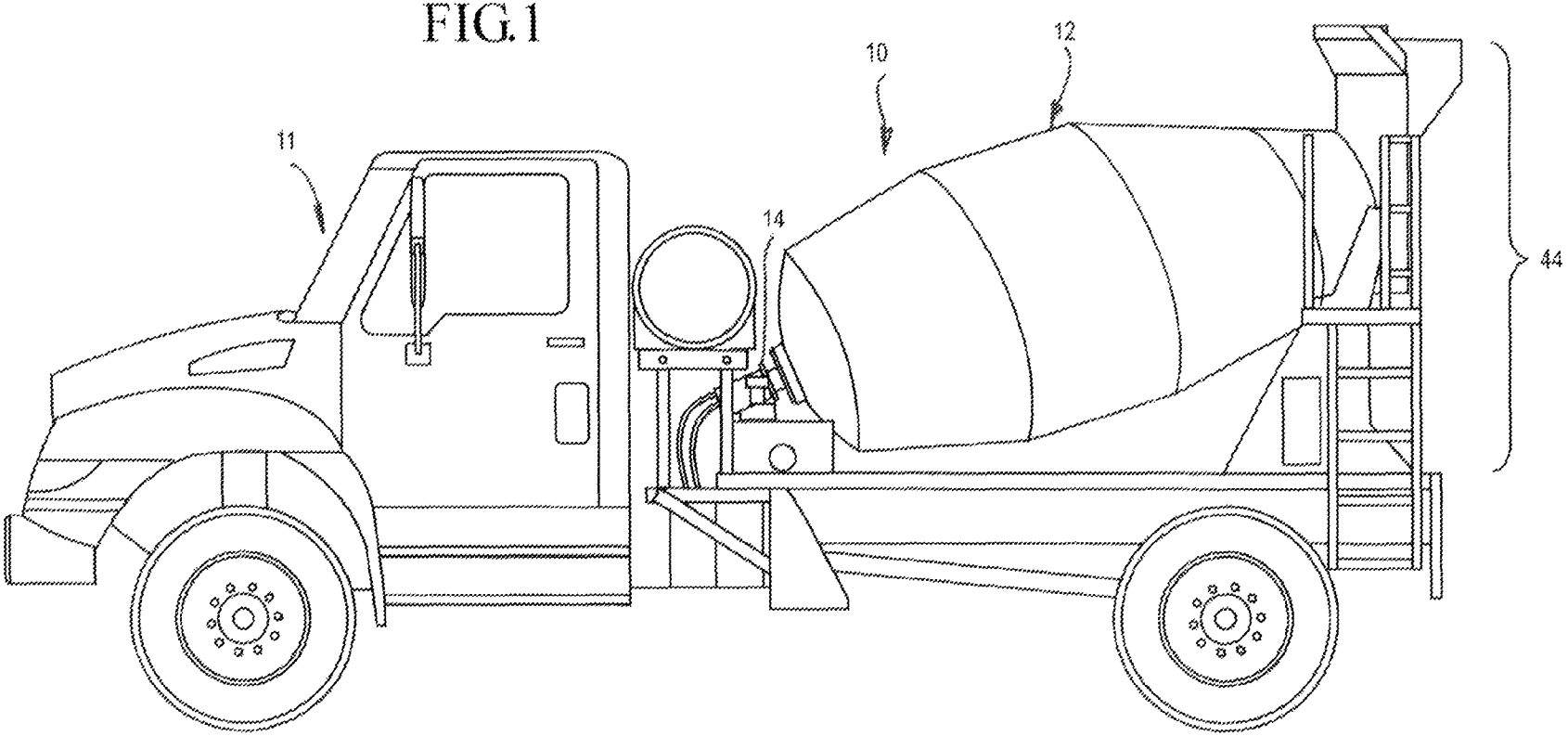
FIG. 1 is an elevational view of a concrete mixer truck with a power system embodiment operating off the transmission of the truck.

FIG. 1 shows a small or light load concrete mixer truck 10. Concrete truck 10 includes a truck body with a cab 11, and a mixer drum 12 capable of carrying small concrete loads, i.e. two to five cubic yards of concrete. The truck is medium duty, such as 18,000-34,000 GVW or equivalent. Various trucks, even standard light duty trucks can, however, be used. Mixer drum 12 is maintained in a spinning mode by a planetary drive assembly 14, which is conventional and thus not shown in detail. In the embodiment shown, the transmission 16 (FIG. 2) of the truck has a PTO (power take off) drive gear. The PTO drive gear is engine driven and provides direct engine power at a PTO port located at the side of the transmission. The PTO drive gear operates when the truck is moving or stopped. A commercially available example of such a transmission is an Allison Model 3000 or 3500 RDS.

Figure 2:
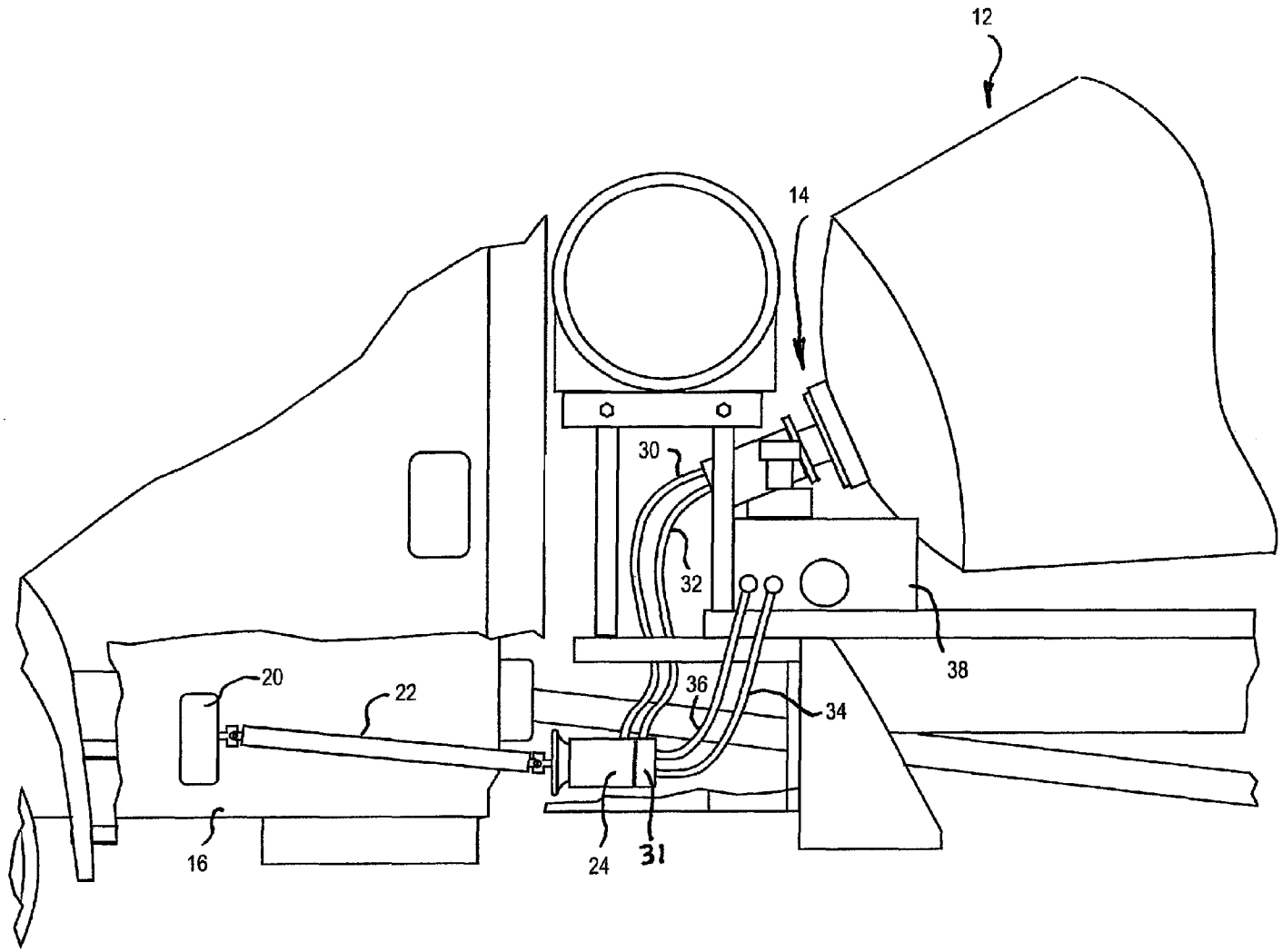
FIG. 2 shows in more detail the embodiment of FIG. 1.
Figure 3:
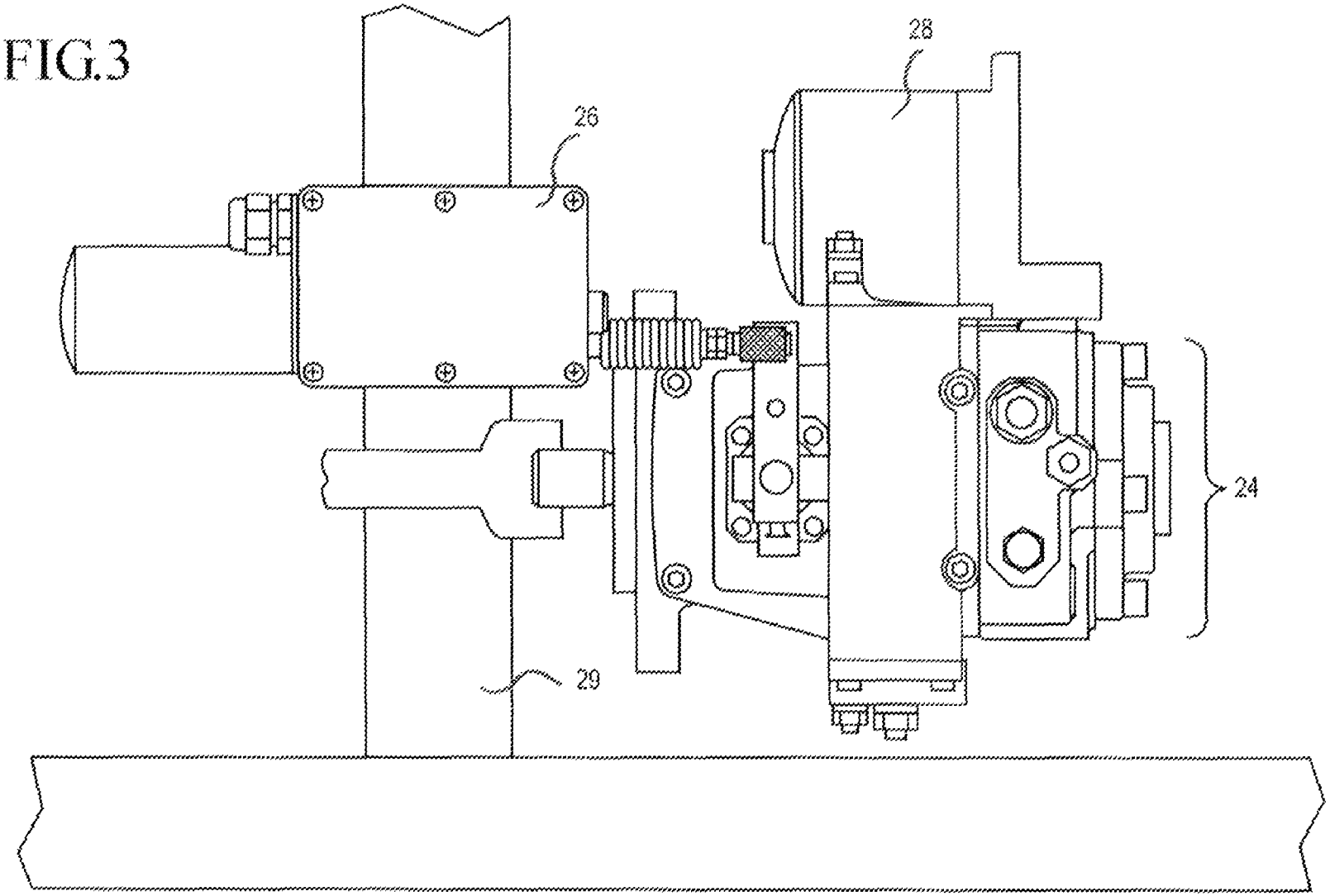
FIG. 3 shows a top view of a pump portion of the power system of FIG. 1 and associated equipment.

Referring to FIG. 2, connected to the transmission PTO port is a PTO unit 20. The PTO unit 20 is also conventional, such as from Chelsea or similar manufacturer. The Chelsea PTO provides full-time power, operating off of the engine through the transmission, i.e. as long as the engine is running, PTO unit 20 is capable of supplying power. Extending from PTO unit 20 is a mechanical drive line 22, which in the embodiment shown extends to a hydraulic pump 24. Hydraulic pump 24 is a variable displacement axial piston pump, also available commercially. The pump can either be a closed circuit or an open circuit pump. A suitable pump is available from Bondioli and Pavesi or similar manufacturer. Associated with the pump is a 12V actuator 26 and an oil filter 28 (FIG. 3). The pump 28 is mounted on a bracket which in turn is mounted to the frame 29 of the truck.

Two hydraulic lines 30 and 32 extend between the pump 24 and the planetary drive 14, for controlling the planetary drive 14. This is a conventional arrangement for concrete mixer trucks. Fluid can flow in both directions through lines 30 and 32, so that drum 12 can be turned in both rotational directions. Conventional controls 31 on the pump permit an operator to control the direction of the fluid and hence the direction of the spinning of the drum.

Two additional hydraulic lines 34 and 36 extend between pump 24 and a fluid reservoir 38, one line carrying fluid from the pump to the reservoir and the other carrying fluid from the reservoir back to the pump.

In operation, mixer drum 12 will be continuously turning in one direction or the other as long as the engine of the truck is running. The mixer drum will continue to turn even through the truck may be stopped. This has the advantage of maintaining the concrete in a proper mix state. At a construction site, a discharge assembly 44, mounted to the rear of the truck 10, directs concrete exiting from drum 12 down a chute portion of the discharge assembly to the desired location for the concrete.

While the embodiment shown includes a connecting drive line between the PTO 20 and the pump 24, the pump can alternatively be mounted directly to the output port of the PTO.

The system shown and described herein is advantageous, since it provides a constantly turning drum capability for a concrete truck carrying small loads, i.e. two to five cubic yards, without requiring an engine flywheel take off assembly. Hence, a conventional medium or even light truck can be used, with a proper transmission, to carry a small/light size concrete drum.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A power system for turning a drum on a small load concrete mixer truck having an engine, comprising:

a power take-off unit connected to a power take off gear in a transmission for the small load concrete mixer truck, wherein the power take-off gear is driven by the engine, so that it is always operating, driving the power take-off unit, when the engine is running, regardless of whether the transmission is engaged or not;

a hydraulic pump powered by the power take-off unit; and hydraulic lines connecting the pump to a fluid reservoir and to a drive system for a mixing drum on the truck, wherein the mixing drum is structurally limited to receiving a load of concrete in the range of only two to five cubic yards, wherein the mixing drum continues to turn as long as the engine of the truck is running.

2. The power system of claim 1, including a separate mechanical drive connection between the power take-off unit and the pump.

3. The power system of claim 1, wherein the pump is connected to and driven by the power take-off unit.

4. The power system of claim 1, including hydraulic fluid lines extending between the pump and a fluid reservoir and hydraulic fluid lines extending between the pump and a drive system for turning the drum.

5. The power system of claim 1, wherein the hydraulic pump includes user-operated controls to permit fluid to flow in both directions between the pump and the drive system for the drum, thereby permitting the drum to turn in both rotational directions.

* * * * *